US008790084B2

(12) United States Patent
Manning et al.

(10) Patent No.: US 8,790,084 B2
(45) Date of Patent: Jul. 29, 2014

(54) AIRFOIL AND METHOD OF FABRICATING THE SAME

(75) Inventors: Robert Francis Manning, Newburyport, MA (US); Victor Hugo Silva Correia, Milton Mills, NH (US)

(73) Assignee: General Electric Company, Schenectady, NY (US)

( * ) Notice: Subject to any disclaimer, the term of this patent is extended or adjusted under 35 U.S.C. 154(b) by 465 days.

(21) Appl. No.: 13/285,783

(22) Filed: Oct. 31, 2011

(65) Prior Publication Data

US 2013/0108469 A1 May 2, 2013

(51) Int. Cl.
*F01D 5/18* (2006.01)

(52) U.S. Cl.
USPC ..... 416/97 R

(58) Field of Classification Search
CPC ..... F01D 5/186; F01D 5/187
USPC ..... 415/115; 416/97 R
See application file for complete search history.

(56) References Cited

U.S. PATENT DOCUMENTS

| | | | | |
|---|---|---|---|---|
| 3,628,885 | A * | 12/1971 | Sidenstick et al. | 416/217 |
| 5,503,529 | A * | 4/1996 | Anselmi et al. | 416/97 R |
| 6,164,913 | A | 12/2000 | Reddy | |
| 6,257,831 | B1 * | 7/2001 | Papple et al. | 416/97 R |
| 6,270,317 | B1 | 8/2001 | Manning et al. | |
| 6,602,047 | B1 | 8/2003 | Barreto et al. | |
| 6,746,209 | B2 | 6/2004 | DeMarche et al. | |
| 7,484,928 | B2 | 2/2009 | Arness et al. | |
| 7,674,092 | B2 * | 3/2010 | Annerfeldt et al. | 416/97 R |
| 7,806,650 | B2 | 10/2010 | Heyward et al. | |
| 2008/0152475 | A1 | 6/2008 | Zausner et al. | |
| 2008/0273971 | A1 | 11/2008 | Grady et al. | |
| 2009/0003987 | A1 | 1/2009 | Zausner et al. | |

* cited by examiner

*Primary Examiner* — Ninh H Nguyen
(74) *Attorney, Agent, or Firm* — William Scott Andes, Esq.; Armstrong Teasdale LLP

(57) ABSTRACT

An airfoil includes a leading edge, a trailing edge, and a pair of sides extending from the leading edge to the trailing edge. The airfoil also includes an internal cooling flow passage defined between the sides, wherein the passage has a passage axis along which cooling air is to flow. The airfoil further includes a plurality of flow paths extending through at least one of the sides such that the flow paths are configured to discharge cooling air from the passage, wherein each of the flow paths has a broken flow path axis oriented to intersect the passage axis at an acute angle.

20 Claims, 4 Drawing Sheets

AIRFOIL AND METHOD OF FABRICATING THE SAME

BACKGROUND OF THE INVENTION

The field of this disclosure relates generally to airfoils and, more particularly, to a gas turbine engine airfoil and a method of fabricating the same.

Most known gas turbine engines have a compressor system, a combustion system, and a turbine system. During operation, compressed air from the compressor system is directed into the combustion system, and the compressed air is mixed with fuel and ignited in the combustion system to generate a flow of combustion gases. The flow of combustion gases is directed into the turbine system, which includes at least one stage having an annular stator followed by an annular rotor. The stator has a row of stator airfoils (i.e., stator vanes), and the rotor has a row of rotor airfoils (i.e., rotor blades). In this manner, the combustion gases flow through the stator vanes and over the rotor blades to spin the rotor, which generates shaft power for the compressor system or a generator.

It is known that increasing the temperature associated with the combustion process can yield an increase in the combustion gas temperature and, therefore, an increase in engine operating efficiency. It is also known that increasing the combustion gas temperature can induce significant thermal stresses on the airfoils of the turbine system, thereby decreasing the useful life of the turbine airfoils. As a result, at least some known turbine airfoils are cooled via a cooling process that discharges cooling air from apertures of the airfoils, which enables the airfoils to better withstand a temperature increase in the combustion gas flow. However, it is also known that discharging cooling air into the combustion gas flow can lower the temperature of the combustion gases, thereby detracting from the operating efficiencies that were to be gained via the temperature increase in the combustion process. It would be useful, therefore, to provide airfoils that can be cooled in a manner that increases the useful life of the airfoils with less affect on engine operating efficiency.

BRIEF DESCRIPTION OF THE INVENTION

In one aspect, an airfoil is provided. The airfoil includes a leading edge, a trailing edge, and a pair of sides extending from the leading edge to the trailing edge. The airfoil also includes an internal cooling flow passage defined between the sides, wherein the passage has a passage axis along which cooling air is to flow. The airfoil further includes a plurality of flow paths extending through at least one of the sides such that the flow paths are configured to discharge cooling air from the passage, wherein each of the flow paths has a broken flow path axis oriented to intersect the passage axis at an acute angle.

In another aspect, a method of fabricating an airfoil is provided. The method includes forming a leading edge, a trailing edge, and a pair of sides extending from the leading edge to the trailing edge. The method also includes forming an internal cooling flow passage between the sides, wherein the passage has a passage axis along which cooling air is to flow. The method further includes forming a plurality of flow paths extending through at least one of the sides such that the flow paths are configured to discharge cooling air from the passage, wherein each of the flow paths has a broken flow path axis oriented to intersect the passage axis at an acute angle.

In another aspect, a gas turbine engine is provided. The gas turbine engine includes a combustion system and a turbine system downstream of the combustion system. The turbine system includes an airfoil having a leading edge, a trailing edge, a pair of sides extending from the leading edge to the trailing edge, and an internal cooling flow passage defined between the sides, wherein the passage has a passage axis along which cooling air is to flow. The airfoil also has a plurality of flow paths extending through at least one of the sides such that the flow paths are configured to discharge cooling air from the passage, wherein each of the flow paths has a broken flow path axis oriented to intersect the passage axis at an acute angle.

DETAILED DESCRIPTION OF THE INVENTION

The following detailed description sets forth an airfoil and a method of fabricating the same by way of example and not by way of limitation. The description should clearly enable one of ordinary skill in the art to make and use the airfoil, and the description sets forth several embodiments, adaptations, variations, alternatives, and uses of the airfoil, including what is presently believed to be the best mode thereof. The airfoil is described herein as being applied to a preferred embodiment, namely a turbine system of a gas turbine engine. However, it is contemplated that the airfoil and the method of fabricating the same have general applications in a broad range of systems and/or a variety of other commercial, industrial, and/or consumer applications.

Figure 1:
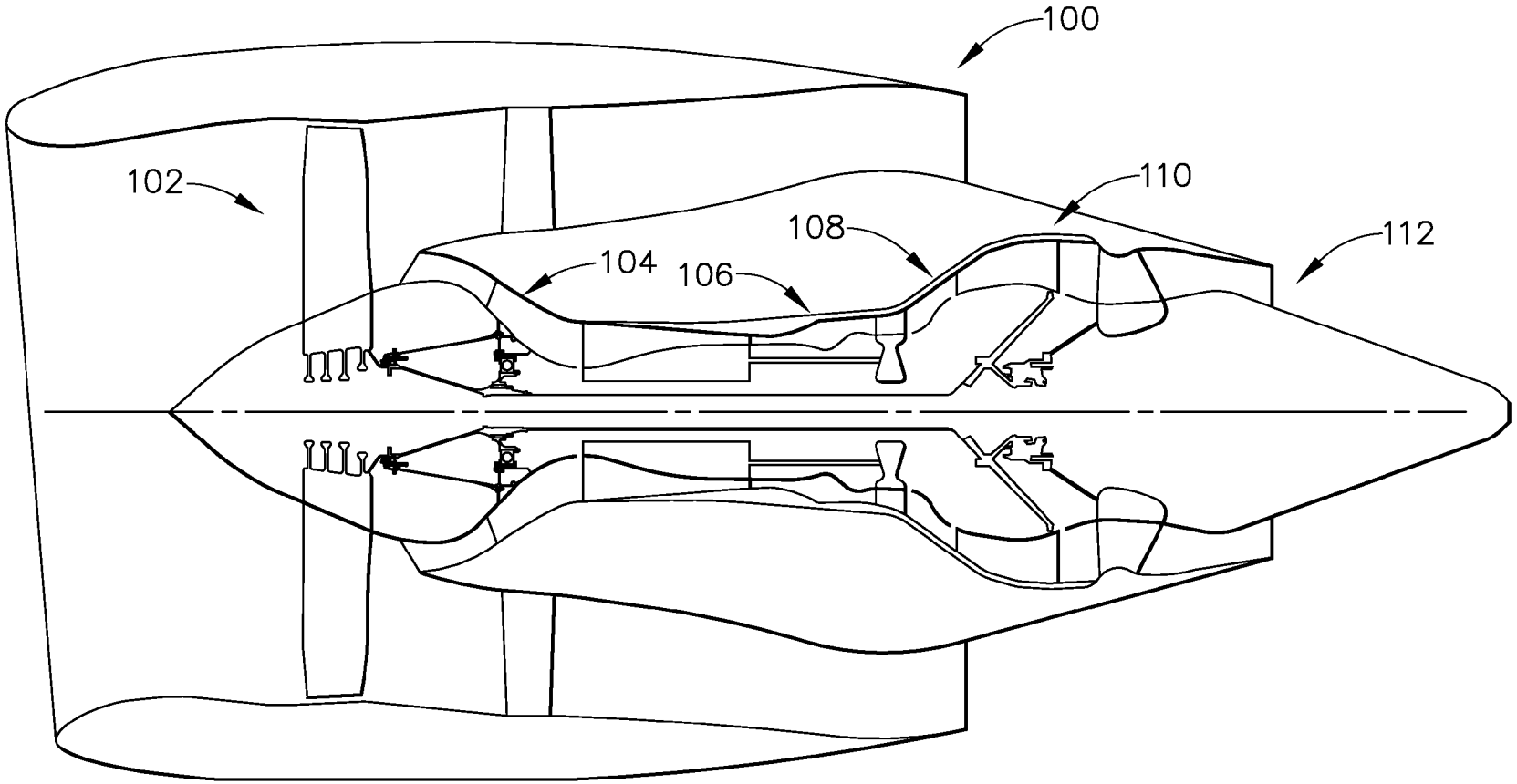
FIG. 1 is schematic illustration of an exemplary gas turbine engine.

FIG. 1 is a schematic illustration of an exemplary gas turbine engine 100 including a fan system 102, a compressor system 104, a combustion system 106, a high pressure turbine system 108, a low pressure turbine system 110, and an exhaust system 112. In operation, air flows through fan system 102 and is supplied to compressor system 104. The compressed air is delivered from compressor system 104 to combustion system 106, where it is mixed with fuel and ignited to produce combustion gases. The combustion gases flow from combustion system 106 through turbine systems 108, 110 and exit gas turbine engine 100 via exhaust system 112. In other embodiments, gas turbine engine 100 may include any suitable number of fan systems, compressor systems, combustion systems, turbine systems, and/or exhaust systems arranged in any suitable manner.

Figure 2:
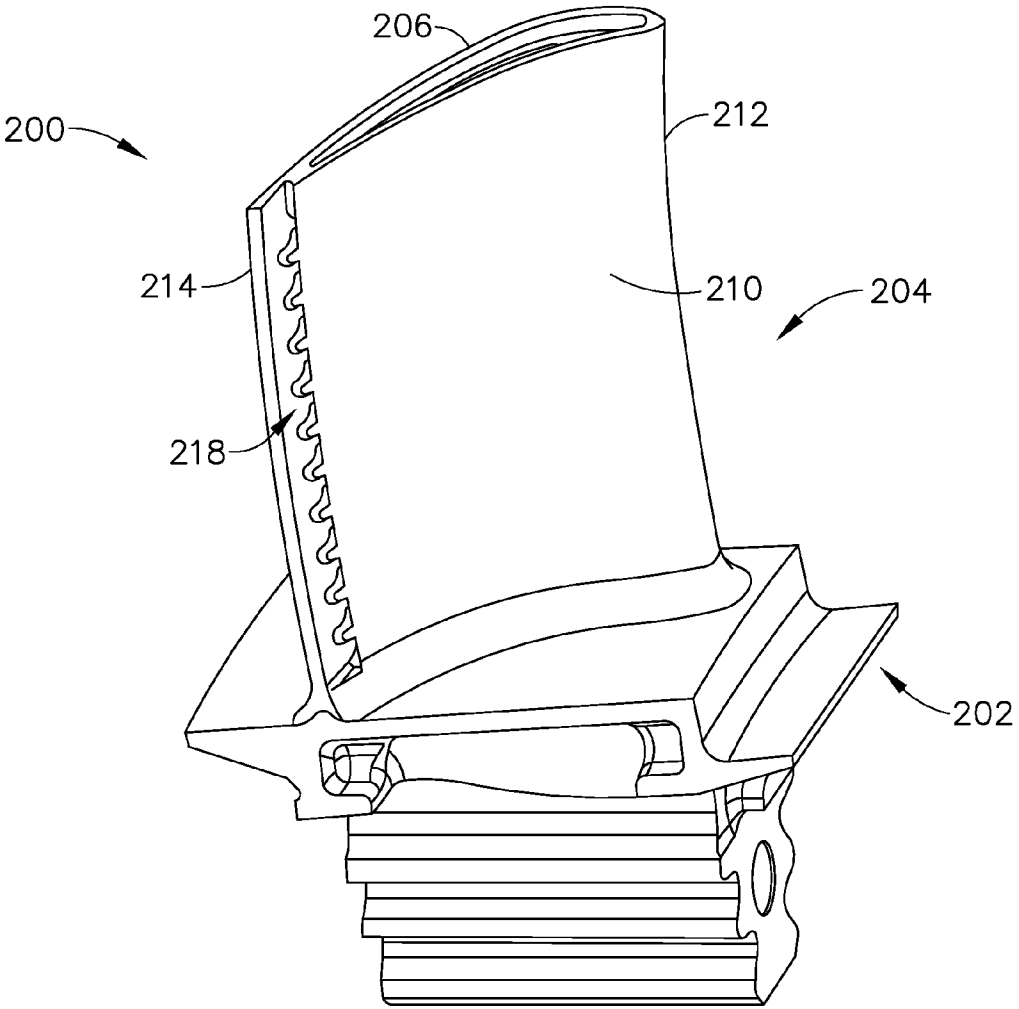
FIG. 2 is a perspective view of an exemplary rotor blade of a turbine system of the gas turbine engine shown in FIG. 1.
Figure 3:
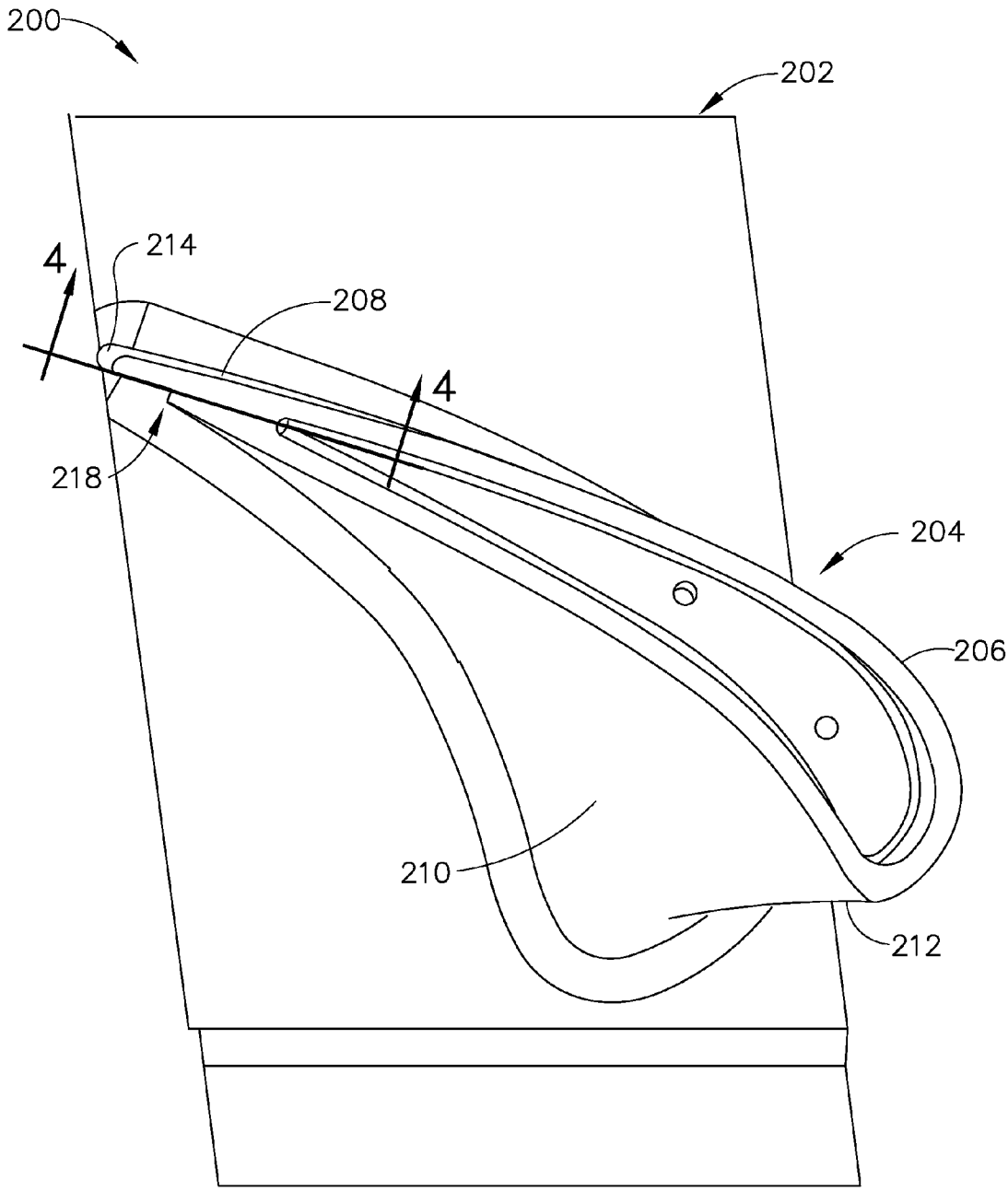
FIG. 3 is a top view of the rotor blade shown in FIG. 2.

FIGS. 2 and 3 are perspective and top views, respectively, of an exemplary rotor blade 200 of high pressure turbine system 108. In the exemplary embodiment, rotor blade 200 includes a platform segment 202 and an airfoil 204 integrally formed with, and extending from, platform segment 202. In other embodiments, airfoil 204 may be configured for use as a stator vane of high pressure turbine system 108. Alternatively, airfoil 204 may be configured for use in any suitable system of gas turbine engine 100 (e.g., low pressure turbine system 110).

In the exemplary embodiment, airfoil 204 extends in span from a platform segment 202 of rotor blade 200 to a blade tip 206 of rotor blade 200. Airfoil 204 includes a first contoured sidewall 208 and a second contoured sidewall 210 that converge at a leading edge 212 and an opposite trailing edge 214. First contoured sidewall 208 is convex and defines a suction side of airfoil 204, and second contoured sidewall 210 is concave and defines a pressure side of airfoil 204. As described in more detail below, airfoil 204 has a generally spanwise configuration 218 of cooling apertures on second contoured sidewall 210 proximate to trailing edge 214. In other embodiments, sidewalls 208, 210 may have any suitable contours, and configuration 218 of cooling apertures may have any suitable orientation and location on airfoil 204.

Figure 4:
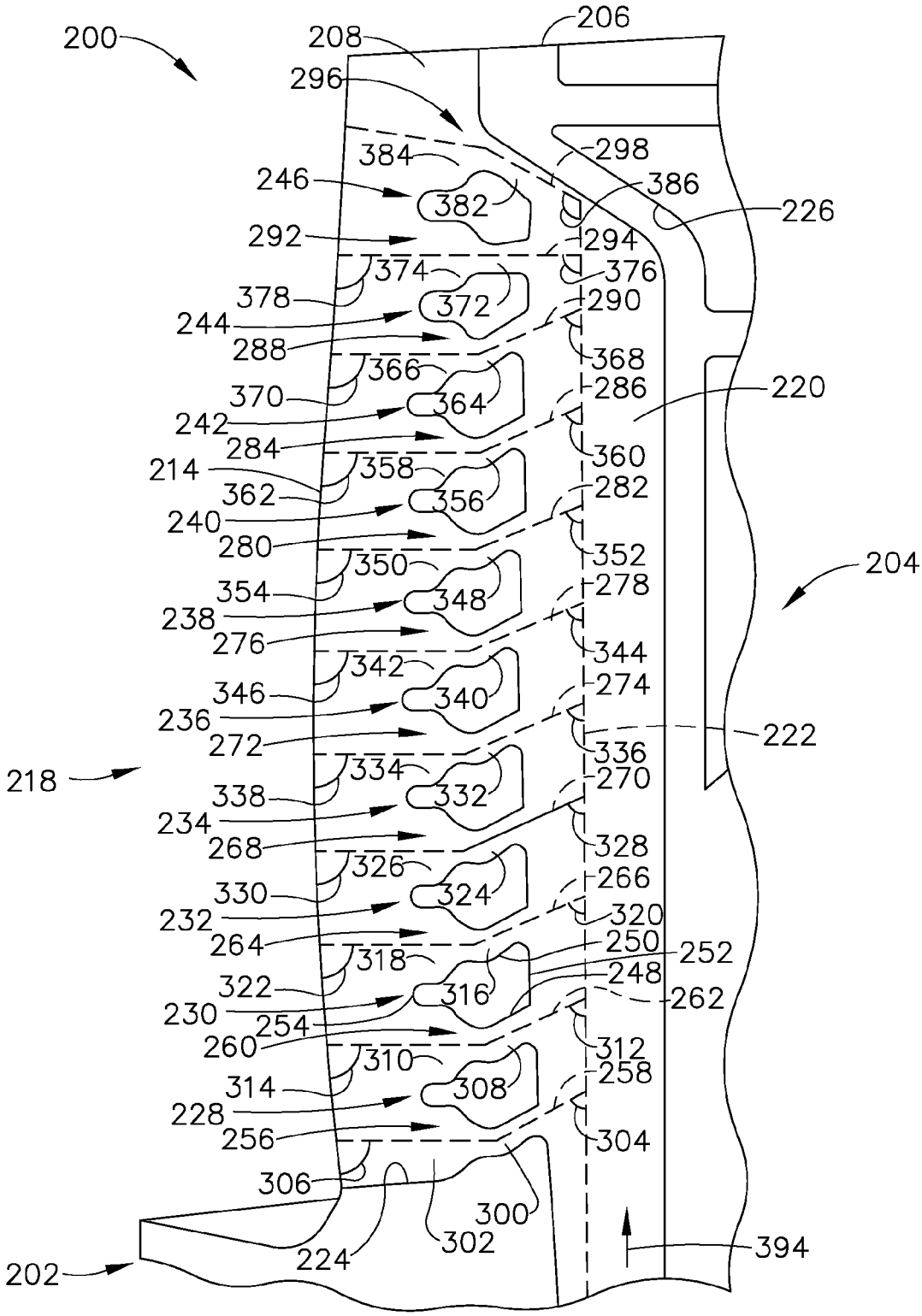
FIG. 4 is a sectional view of the rotor blade shown in FIG. 3 and taken along line 4-4.

FIG. 4 is a sectional view of airfoil 204 taken along line 4-4 of FIG. 3. In the exemplary embodiment, airfoil 204 has an internal cooling flow passage 220 disposed between first and second sidewalls 208, 210, and passage 220 has a passage axis 222 (i.e., a centerline axis) oriented in a generally spanwise direction such that passage 220 is in flow communication with configuration 218 of cooling apertures, as described in more detail below. Configuration 218 of cooling apertures includes an inner boundary 224, an outer boundary 226, and a plurality of spaced-apart guide fingers that are integrally formed with first contoured sidewall 208 and second contoured sidewall 210, namely a first guide finger 228, a second guide finger 230, a third guide finger 232, a fourth guide finger 234, a fifth guide finger 236, a sixth guide finger 238, a seventh guide finger 240, an eighth guide finger 242, a ninth guide finger 244, and a tenth guide finger 246. Each guide finger 228, 230, 232, 234, 236, 238, 240, 242, 244, 246 has an inner contour 248 and an outer contour 250 joined together at, and extending between, a base surface 252 and a finger tip 254. In the exemplary embodiment, base surfaces 252 are oriented to be substantially parallel to passage axis 222. In some embodiments, base surfaces 252 may have any suitable orientation that facilitates enabling airfoil 204 to function as described herein. In other embodiments, airfoil 204 may have any suitable number of guide fingers. As used herein, the term "inner" refers to being located closer to platform segment 202 than to blade tip 206 along the span of airfoil 204, and the term "outer" refers to being located closer to blade tip 206 than to platform segment 202 along the span of airfoil 204. Similarly, the term "inwardly facing" refers to facing toward platform segment 202 rather than facing toward blade tip 206, and the term "outwardly facing" refers to facing toward blade tip 206 rather than facing toward platform segment 202.

In this manner, a first flow path 256 is defined between inner boundary 224 and inner contour 248 of first guide finger 228 along a first flow path axis 258 (i.e., a centerline axis); a second flow path 260 is defined between outer contour 250 of first guide finger 228 and inner contour 248 of second guide finger 230 along a second flow path axis 262 (i.e., a centerline axis); a third flow path 264 is defined between outer contour 250 of second guide finger 230 and inner contour 248 of third guide finger 232 along a third flow path axis 266 (i.e., a centerline axis); a fourth flow path 268 is defined between outer contour 250 of third guide finger 232 and inner contour 248 of fourth guide finger 234 along a fourth flow path axis 270 (i.e., a centerline axis); a fifth flow path 272 is defined between outer contour 250 of fourth guide finger 234 and inner contour 248 of fifth guide finger 236 along a fifth flow path axis 274 (i.e., a centerline axis); a sixth flow path 276 is defined between outer contour 250 of fifth guide finger 236 and inner contour 248 of sixth guide finger 238 along a sixth flow path axis 278 (i.e., a centerline axis); a seventh flow path 280 is defined between outer contour 250 of sixth guide finger 238 and inner contour 248 of seventh guide finger 240 along a seventh flow path axis 282 (i.e., a centerline axis); an eighth flow path 284 is defined between outer contour 250 of seventh guide finger 240 and inner contour 248 of eighth guide finger 242 along an eighth flow path axis 286 (i.e., a centerline axis); a ninth flow path 288 is defined between outer contour 250 of eighth guide finger 242 and inner contour 248 of ninth guide finger 244 along a ninth flow path axis 290 (i.e., a centerline axis); a tenth flow path 292 is defined between outer contour 250 of ninth guide finger 244 and inner contour 248 of tenth guide finger 246 along a tenth flow path axis 294 (i.e., a centerline axis); and an eleventh flow path 296 is defined between outer contour 250 of tenth guide finger 246 and outer boundary 226 along an eleventh flow path axis 298 (i.e., a centerline axis).

First flow path 256 includes a first channel segment 300 and a first delta segment 302, and first channel segment 300 is contoured such that first flow path axis 258 intersects passage axis 222 at a first inwardly facing acute angle 304 and intersects trailing edge 214 at a first substantially right angle 306. Second flow path 260 includes a second channel segment 308 and a second delta segment 310, and second channel segment 308 is contoured such that second flow path axis 262 intersects passage axis 222 at a second inwardly facing acute angle 312 and intersects trailing edge 214 at a second substantially right angle 314. Third flow path 264 includes a third channel segment 316 and a third delta segment 318, and third channel segment 316 is contoured such that third flow path axis 266 intersects passage axis 222 at a third inwardly facing acute angle 320 and intersects trailing edge 214 at a third substantially right angle 322. Fourth flow path 268 includes a fourth channel segment 324 and a fourth delta segment 326, and fourth channel segment 324 is contoured such that fourth flow path axis 270 intersects passage axis 222 at a fourth inwardly facing acute angle 328 and intersects trailing edge 214 at a fourth substantially right angle 330. Fifth flow path 272 includes a fifth channel segment 332 and a fifth delta segment 334, and fifth channel segment 332 is contoured such that fifth flow path axis 274 intersects passage axis 222 at a fifth inwardly facing acute angle 336 and intersects trailing edge 214 at a fifth substantially right angle 338.

Similarly, sixth flow path 276 includes a sixth channel segment 340 and a sixth delta segment 342, and sixth channel segment 340 is contoured such that sixth flow path axis 278 intersects passage axis 222 at a sixth inwardly facing acute angle 344 and intersects trailing edge 214 at a sixth substantially right angle 346. Seventh flow path 280 includes a seventh channel segment 348 and a seventh delta segment 350, and seventh channel segment 348 is contoured such that seventh flow path axis 282 intersects passage axis 222 at a seventh inwardly facing acute angle 352 and intersects trailing edge 214 at a seventh substantially right angle 354. Eighth flow path 284 includes an eighth channel segment 356 and an eighth delta segment 358, and eighth channel segment 356 is contoured such that eighth flow path axis 286 intersects passage axis 222 at an eighth inwardly facing acute angle 360 and intersects trailing edge 214 at an eighth substantially right angle 362. Ninth flow path 288 includes a ninth channel segment 364 and a ninth delta segment 366, and ninth channel segment 364 is contoured such that ninth flow path axis 290 intersects passage axis 222 at a ninth inwardly facing acute angle 368 and intersects trailing edge 214 at a ninth substantially right angle 370.

In this manner, each axis 258, 262, 266, 270, 274, 278, 282, 286, 290 is broken (e.g., is angled or changes direction) at an intermediate segment of its respective flow path 256, 260, 264, 268, 272, 276, 280, 284, 288. In the exemplary embodiment, flow paths 256, 260, 264, 268, 272, 276, 280, 284, 288 receive cooling air in a first direction that is acute relative to passage axis 222 and discharge the cooling air in a second direction that is different than the first direction and is substantially perpendicular to trailing edge 214. In one embodiment, acute angles 304, 312, 320, 328, 336, 344, 352, 360, 368 are substantially the same and are between about 20° and about 70°. In another embodiment, acute angles 304, 312, 320, 328, 336, 344, 352, 360, 368 are substantially the same and are about 35°. In the exemplary embodiment, each channel segment 300, 308, 316, 324, 332, 340, 348, 356, 364 is generally L-shaped. In other embodiments, channel segments 300, 308, 316, 324, 332, 340, 348, 356, 364 may have any suitable shapes that enable flow paths 256, 260, 264, 268, 272, 276, 280, 284, 288 to receive and discharge cooling air as described herein.

In the exemplary embodiment, tenth flow path 292 includes a tenth channel segment 372 and a tenth delta segment 374, and tenth channel segment 372 is contoured such that tenth flow path axis 294 intersects passage axis 222 and trailing edge 214 at tenth substantially right angles 376, 378. Additionally, eleventh flow path 296 includes an eleventh channel segment 382 and an eleventh delta segment 384, and eleventh channel segment 382 is contoured such that eleventh flow path axis 298 intersects passage axis 222 at an eleventh outwardly facing acute angle 386.

During operation of the exemplary embodiment, a flow 394 of cooling air is directed through passage 220 along passage axis 222 and is discharged from passage 220 via flow paths 256, 260, 264, 268, 272, 276, 280, 284, 288, 292, 296. Because flow paths 256, 260, 264, 268, 272, 276, 280, 284, 288 have flow path axes 258, 262, 266, 270, 274, 278, 282, 286, 290 that are oriented at inwardly facing acute angles 304, 312, 320, 328, 336, 344, 352, 360, 368, the flow 394 of cooling air in passage 220 slows upon entry into flow paths 256, 260, 264, 268, 272, 276, 280, 284, 288. More specifically, the acute orientations of channel segments 300, 308, 316, 324, 332, 340, 348, 356, 364 relative to passage axis 222 create more tortuous paths for the cooling air and, therefore, facilitate slowing the cooling air upon entry into flow paths 256, 260, 264, 268, 272, 276, 280, 284, 288 from passage 220, thereby reducing the rate at which the cooling air is discharged from flow paths 256, 260, 264, 268, 272, 276, 280, 284, 288. Additionally, because tenth flow path axis 294 intersects passage axis 222 at tenth substantially right angle 376, cooling air enters tenth flow path 292 at a higher rate than the rate at which cooling air enters flow paths 256, 260, 264, 268, 272, 276, 280, 284, 288. Similarly, because eleventh flow path axis 298 intersects passage axis 222 at eleventh outwardly facing acute angle 386, cooling air enters eleventh flow path 296 at a higher rate than the rate at which cooling air enters tenth flow path 292. Furthermore, delta segments 302, 310, 318, 326, 334, 342, 350, 358, 366, 374, 384 facilitate spreading the cooling air exiting channel segments 300, 308, 316, 324, 332, 340, 348, 356, 364, 372, 382 such that cooling air is discharged from configuration 218 along the entirety of trailing edge 214 to facilitate cooling airfoil 204 at trailing edge 214. Moreover, it should be noted that, while configuration 218 of cooling apertures is a configuration of trailing edge cooling apertures in the exemplary embodiment, the methods and systems described herein would be useful with respect to any suitable configuration of cooling apertures located in any suitable segment of gas turbine engine 100.

The methods and systems described herein facilitate providing an improved turbine airfoil trailing edge cooling slot geometry for discharging cooling air from an airfoil. The methods and systems described herein further facilitate providing cooling flow slots that facilitate reducing parasitic airfoil cooling flow and/or providing enhanced durability of the airfoil with reduced trailing edge metal temperature and thermal gradient. The methods and systems described herein also facilitate reducing cooling slot effective flow and maintaining high slot film cooling effectiveness as a result of flow separation at the slot inlet due to the slot inlet angle. The methods and systems described herein further facilitate providing a desirable slot flow exit angle orientation being aligned with the mainstream hot gas flow along the airfoil chord, thereby maintaining high film cooling effectiveness downstream of the slot breakout on the airfoil. The methods and systems described herein therefore facilitate a net result of obtaining lower airfoil metal temperatures with a lower cooling flow discharge rate.

Additionally, the methods and systems described herein facilitate providing a cooling slot configuration that enables a reduction in land size and metal temperature, which is desirable for advanced engines operating at significantly higher turbine inlet temperatures where the land temperatures become limiting. The methods and systems described herein further facilitate providing a cooling advantage through the subsequent increase in slot area and reduced land area. The methods and systems described herein can therefore be used for achieving a specific fuel consumption (SFC) benefit by reducing parasitic cooling flow level at a given airfoil durability or can be used for increasing airfoil durability while maintaining a given SFC level. As such, an SFC improvement can be achieved while reducing the overall use of cooling air, increasing airfoil durability associated with cooler metal temperatures, and maintaining a desired airfoil cooling flow discharge level.

Exemplary embodiments of an airfoil and a method of fabricating the same are described above in detail. The methods and systems are not limited to the specific embodiments described herein, but rather, components of the methods and systems may be utilized independently and separately from other components described herein. For example, the methods and systems described herein may have other industrial and/or consumer applications and are not limited to practice with only gas turbine engines as described herein. Rather, the present invention can be implemented and utilized in connection with many other industries.

While the invention has been described in terms of various specific embodiments, those skilled in the art will recognize that the invention can be practiced with modification within the spirit and scope of the claims.

What is claimed is:

1. An airfoil comprising:
- a leading edge;
- a trailing edge;
- a pair of sides extending from said leading edge to said trailing edge;
- an internal cooling flow passage defined between said sides, wherein said passage has a passage axis along which cooling air is to flow; and
- a plurality of flow paths extending through at least one of said sides such that said flow paths are configured to discharge cooling air from said passage, wherein the plurality of flow paths include at least:
  - a first flow path of the plurality of flow paths has a broken flow path axis oriented to intersect the passage axis at an acute angle;
  - a second flow path of the plurality of flow paths has a flow path axis oriented to intersect the passage axis orthogonally, and
  - a third flow path of the plurality of flow paths has a broken flow path axis oriented to intersect the passage axis at an obtuse angle.

2. An airfoil in accordance with claim 1, wherein each of said flow paths comprises a channel segment and a delta segment.

3. An airfoil in accordance with claim 2, wherein each of said channel segments is generally L-shaped.

4. An airfoil in accordance with claim 1, wherein said passage is oriented in a substantially spanwise direction of said airfoil proximate said trailing edge such that the acute angles are inwardly facing acute angles.

5. An airfoil in accordance with claim 4, wherein each of the inwardly facing acute angles is between about 20° and about 70°.

6. An airfoil in accordance with claim 4, wherein each of the inwardly facing acute angles is about 35°.

7. An airfoil in accordance with claim 4, wherein the flow path axes are oriented to intersect said trailing edge at substantially right angles.

8. A method of fabricating an airfoil, said method comprising:

forming a leading edge, a trailing edge, and a pair of sides extending from the leading edge to the trailing edge;

forming an internal cooling flow passage between the sides, wherein the passage has a passage axis along which cooling air is to flow; and forming a plurality of flow paths extending through at least one of the sides such that the flow paths are configured to discharge cooling air from the passage, wherein the plurality of flow paths include at least:

a first flow path of the plurality of flow paths has a broken flow path axis oriented to intersect the passage axis at an acute angle;

a second flow path of the plurality of flow paths has a flow path axis oriented to intersect the passage axis orthogonally, and a third flow path of the plurality of flow paths has a broken flow path axis oriented to intersect the passage axis at an obtuse angle.

9. A method in accordance with claim 8, wherein forming a plurality of flow paths comprises forming each of the flow paths to include a channel segment and a delta segment.

10. A method in accordance with claim 9, wherein forming each of the flow paths to include a channel segment and a delta segment comprises forming each of the channel segments to be generally L-shaped.

11. A method in accordance with claim 8, wherein forming an internal cooling flow passage comprises forming the passage such that the passage is oriented in a substantially spanwise direction of the airfoil proximate the trailing edge, and wherein forming a plurality of flow paths comprises forming the flow paths such that the acute angles are inwardly facing acute angles.

12. A method in accordance with claim 11, wherein forming the flow paths such that the acute angles are inwardly facing acute angles comprises forming each of the inwardly facing acute angles to be between about 20° and about 70°.

13. A method in accordance with claim 11, wherein forming the flow paths such that the acute angles are inwardly facing acute angles comprises forming each of the inwardly facing acute angles to be about 35°.

14. A method in accordance with claim 11, wherein forming a plurality of flow paths further comprises forming the flow path axes such that the flow path axes are oriented to intersect the trailing edge at substantially right angles.

15. A gas turbine engine comprising:

a combustion system; and a turbine system downstream of said combustion system, wherein said turbine system comprises an airfoil comprising:

a leading edge;

a trailing edge;

a pair of sides extending from said leading edge to said trailing edge;

an internal cooling flow passage defined between said sides, wherein said passage has a passage axis along which cooling air is to flow; and a plurality of flow paths extending through at least one of said sides such that said flow paths are configured to discharge cooling air from said passage, wherein the plurality of flow paths include at least:

a first flow path of the plurality of flow paths has a broken flow path axis oriented to intersect the passage axis at an acute angle;

a second flow path of the plurality of flow paths has a flow path axis oriented to intersect the passage axis orthogonally, and a third flow path of the plurality of flow paths has a broken flow path axis oriented to intersect the passage axis at an obtuse angle.

16. A gas turbine engine in accordance with claim 15, wherein each of said flow paths comprises a channel segment and a delta segment.

17. A gas turbine engine in accordance with claim 16, wherein each of said channel segments is generally L-shaped.

18. A gas turbine engine in accordance with claim 15, wherein said passage is oriented in a substantially spanwise direction of said airfoil proximate said trailing edge such that the acute angles are inwardly facing acute angles.

19. A gas turbine engine in accordance with claim 18, wherein each of the inwardly facing acute angles is between about 20° and about 70°.

20. A gas turbine engine in accordance with claim 18, wherein each of the inwardly facing acute angles is about 35°.

* * * * *